US008734192B2

(12) United States Patent
He et al.

(10) Patent No.: US 8,734,192 B2
(45) Date of Patent: May 27, 2014

(54) TERMINAL HAVING A CLAMPING SPRING

(75) Inventors: Xiaoyong He, Korneuburg (AT); Harald Schweigert, Vienna (AT)

(73) Assignee: Siemens Aktiengesellschaft, Munich (DE)

( * ) Notice: Subject to any disclaimer, the term of this patent is extended or adjusted under 35 U.S.C. 154(b) by 83 days.

(21) Appl. No.: 13/377,517

(22) PCT Filed: Apr. 29, 2010

(86) PCT No.: PCT/EP2010/055828
§ 371 (c)(1),
(2), (4) Date: Dec. 9, 2011

(87) PCT Pub. No.: WO2010/142494
PCT Pub. Date: Dec. 16, 2010

(65) Prior Publication Data

US 2012/0077391 A1 Mar. 29, 2012

(30) Foreign Application Priority Data

Jun. 10, 2009 (AT) ..... A 899/2009

(51) Int. Cl.
*H01R 4/38* (2006.01)

(52) U.S. Cl.
USPC ..... 439/815

(58) Field of Classification Search
USPC ..... 439/815, 828, 829
See application file for complete search history.

(56) References Cited

U.S. PATENT DOCUMENTS

| | | | | |
|---|---|---|---|---|
| 3,891,297 | A | 6/1975 | Poliak et al. | |
| 6,146,187 | A | 11/2000 | Pallai | |
| 6,689,955 | B2 * | 2/2004 | Doutaz | 174/652 |
| 7,097,518 | B2 * | 8/2006 | Kraemer et al. | 439/806 |
| 7,179,137 | B1 * | 2/2007 | Quendt et al. | 439/828 |
| 7,651,363 | B2 * | 1/2010 | Koellmann | 439/441 |
| 2008/0233782 | A1 | 9/2008 | Hoppmann | |

FOREIGN PATENT DOCUMENTS

| | | |
|---|---|---|
| CH | 552286 | 7/1974 |
| DE | 10037550 | 2/2002 |
| DE | 10205470 | 8/2003 |
| DE | 102005050267 | 4/2007 |
| DE | 102007016333 | 10/2008 |
| EP | 2034562 | 3/2009 |
| FR | 2819110 | 7/2002 |

* cited by examiner

*Primary Examiner* — Phuong Dinh
(74) *Attorney, Agent, or Firm* — Cozen O'Connor

(57) ABSTRACT

A terminal for at least one electrical conductor, comprising a terminal socket and a clamping spring, wherein a clamping force applied by the clamping spring clamps the electrical conductor to the terminal socket, and wherein a screw coupled to a support element is provided, by which at least one section of the clamping spring is movable relative to the terminal socket.

13 Claims, 6 Drawing Sheets

TERMINAL HAVING A CLAMPING SPRING

CROSS-REFERENCE TO RELATED APPLICATIONS

This is a U.S. national stage of application No. PCT/EP2010/055828 filed 29 Apr. 2010. Priority is claimed on Austia Application No. A899/2009 filed 10 Jun. 2009, the content of which is incorporated herein by reference in its entirety.

BACKGROUND OF THE INVENTION

1. Field of the Invention

The invention relates to connector terminals and, more particularly, to a terminal for at least one electrical conductor, where the terminal comprises a terminal base and a clamping spring applying a clamping force applied by to clamp the electrical conductor to the terminal base.

2. Description of the Related Art

Terminals are used in a multiplicity of different electrical devices and systems, as well as generally for electrical installation purposes. With such terminals, in contrast to a screw-type terminal, a clamping force is applied by a clamping spring. The clamping of an electrical conductor is accomplished, for example, in that a clamping edge clamps a bared end of the electrical conductor against the terminal base, as shown in a known terminal depicted in FIG. 1. Hope, the clamping edge is disposed on the clamping spring itself. Normally, the clamping action is effected such that the inserted end of the electrical conductor causes the clamping edge bearing on the terminal base to move back. The spring can also be tensioned by an auxiliary tool, e.g., a screwdriver. For that purpose, an opening is provided in a housing of the terminal through which the auxiliary tool is introduced, and in the process acts on the clamping spring. In this way, it is also possible to release a clamped electrical conductor once more.

A disadvantage with these generic terminals is a lower level of clamping reliability than in the case of screw-type terminals, i.e., with terminal contacts which are exposed to vibrations or other mechanical influences. The clamping force exerted by the clamping spring is often not enough to permanently clamp an electrical conductor permanently with a low contact resistance against the terminal base.

A high level of clamping reliability to avoid system outages is required, particularly in the field of automation technology comprising extensive electrical installations such as the wiring of power supplies in switching cabinets, for example. In particular, the automobile industry stipulates that only screw-type terminals should be used in switching cabinets for car production plants.

This requirement is also fulfilled by a combination terminal in DE 35 04 317 A1. With this solution, a clamping device with, a clamping spring, and a clamping device with a clamping screw are provided in a housing. An electrical conductor is initially clamped to a terminal base by a clamping spring. In addition to the clamping spring, the electrical conductor can also be clamped against the terminal base by a clamping screw. A disadvantageous aspect therein is the amount of space that must be provided for the two clamping devices.

SUMMARY OF THE INVENTION

It is therefore an object of the invention is to provide an improved terminal for an electrical conductor.

This and other objects and advantages are achieved in accordance with the invention by providing a terminal in which a clamping spring is provided that applies a clamping force to clamp an electrical conductor namely to a base of the terminal.

In the terminal in accordance with the invention, a screw is provided which is coupled to a support element and by which at least a section of the clamping spring is movable relative to the terminal base. In this way, the clamping spring itself is used to adjust the clamping force exerted by it by means of the screw. Here, force applied to the clamping spring by the screw intensifies (increases) the clamping force effected by the preloading of the clamping spring, i.e., additional pressure is applied to the clamped conductor by the screw and in the process the conductor is pressed more firmly against the terminal base.

At the same time the advantage of the generic terminal, i.e., enabling fast and consequently cost-effective electrical installation work, is preserved. Moreover, significantly lower clamping error rates are recorded as compared with conventional screw-type terminals, in the case of terminals that are difficult to access. A further advantage lies in the fact that wire end sleeves can be dispensed with. The wire end sleeves are not necessary because the known, slow creep to which a copper conductor is prone under the pressure of the terminal is compensated for by a constant spring pressure.

The screw itself does not directly clamp the electrical conductor tight and accordingly is not disposed in the clamping region. As a result, a terminal of this type is compact in design.

In this arrangement, the screw is guided through a housing of the terminal and the head of the screw is accessible from outside the housing. Screws disposed inside a housing are suitable for varying the spring preload of terminals of per se identical design. With the externally accessible screw, there is furthermore the possibility of increasing the clamping force in an already clamping state.

It is advantageous if a substantially rigid section of the clamping spring that transmits the clamping force onto the electrical conductor is movable relative to the terminal base by the screw. The terminal then acts in respect of clamping reliability like a conventional screw-type terminal in that the force applied by the screw is transmitted onto a substantially rigid clamping leg of the clamping spring. In this arrangement, the clamping leg directly or indirectly clamps the electrical conductor tight by a rigid intermediate element. In the second case, the force applied by the screw can also act directly on the intermediate element, where the clamping spring is also movable relative to the terminal base by the intermediate element.

In an embodiment of the invention, the thread of the screw engages with a thread of the clamping spring and that the screw head is supported on the support element of the terminal. Tightening the screw causes the movable clamping spring section to move in the direction of the terminal base, thereby intensifying (increasing) the clamping force acting on the electrical conductor. With the screw loosened, i.e., with a screw raised away from the support element, the clamping spring section remains freely movable and the terminal functions as a conventional spring clamp terminal.

In another, embodiment the screw has one end coupled to the clamping spring and the thread of the screw engages with a thread of the support element of the terminal. In this case, the clamping spring is implemented in a simple manner without a thread. The coupling has an axial play between screw and clamping spring, in this case, such that the clamping spring can move freely in the region of the axial play.

In the event that a compressive force is to be applied by the screw onto the clamping spring to increase the clamping force, the end of the screw bears on the clamping spring. Here, the axial play is simply achieved by loosening the screw, i.e., by raising the screw a sufficient distance from the clamping spring.

If the screw is coupled to the clamping spring at a point that requires a tensile force from the screw onto the clamping spring in order to increase the clamping force, then the end is formed as a mushroom shape and guided in a groove-shaped recess of the clamping spring. Here, the advantage is that the screw can also be used for loosening the clamping. In this case, the coupling of the screw to the clamping spring possesses a play in the axial direction of the screw. A region for screw positions with a freely movable clamping spring is then provided between the tightening of the screw in one direction of rotation to apply a tensile force and the tightening of the screw in the other direction of rotation to apply a compressive force.

In a further embodiment, the screw is mounted rotatably in the support element and the thread of the screw engages with a thread of an intermediate element coupled to the clamping spring. This causes no displacement of the screw head in the axial direction, as a result of which only the height of the screw head needs to be taken into account with regard to the height of an insulating collar around the screw head. Here, the coupling of the clamping spring to the intermediate element is provided with an axial play to allow free movement of the clamping spring. It is also possible to implement the coupling the between clamping spring and the intermediate element without axial play and to provide the necessary axial play in the mounting of the screw in the support element.

Here, it is advantageous if a cover is movable together with the intermediate element, which cover, when subjected to the clamping force intensified (increase) by the screw, covers an opening in the housing provided for introducing a tool for tensioning the clamping spring and consequently for releasing the electrical conductor. The cover prevents the housing opening from being accessible to a screwdriver for releasing the clamping spring when the clamping spring is fixed by a screw. Inadvertent loosening attempts could lead to the terminal being damaged. As an alternative to the cover of the housing opening, inadvertent loosening attempts can be prevented in that fixing of the clamping spring by a screw is indicated by a mechanical element moved by means of the screw.

A cage which encloses the clamping spring is beneficially provided as the intermediate element. The cage is therein configured such that, at a neutral screw position, the clamping spring is able to move freely within the cage.

It is of advantage if the cage has two resilient bars and a connecting brace having the thread and if the free ends of the bars have extensions that partially grip around the clamping spring. The two resilient bars can then be spread apart by a tool so that the distance between the extensions becomes greater than the width of the clamping spring, thereby enabling the clamping spring to be moved out of the cage.

Alternatively thereto, an intermediate element is provided which comprises a sleeve having an internal thread, where the sleeve is guided in a recess of the clamping spring. Here, the axial guide between the sleeve and the clamping spring has end stops where, an axial play is provided to enable a free movement of the clamping spring at a neutral screw position.

In embodiment, a two-part screw is implemented such that the screw has an inner core on which a sleeve having an external thread is co-rotatably disposed and the external thread engages with an internal thread of the clamping spring. Here, the sleeve and the inner core have an axial play. The clamping spring can move freely at a neutral position of the screw. When the screw is turned, the sleeve moves axially as far as a stop of the core, as a result of which a force is exerted onto the clamping spring.

In another embodiment the support element is connected to the screw such that the support element is implemented as part of the housing in which the terminal base is affixed.

Alternatively thereto, it is advantageous if the support element is held in the housing in which the terminal base is affixed. The support element then comprises, for example, a sleeve made of a material of higher strength than the strength of the housing material.

In further embodiment, that the terminal base and the support element are formed as a single piece.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in an exemplary manner below with reference to the attached schematic figures, in which:

FIG. 5 at different screw positions;

FIG. 5 with a cover;

FIG. 5 with a spreadable cage;

DETAILED DESCRIPTION OF THE PREFERRED EMBODIMENTS

Figure 1:
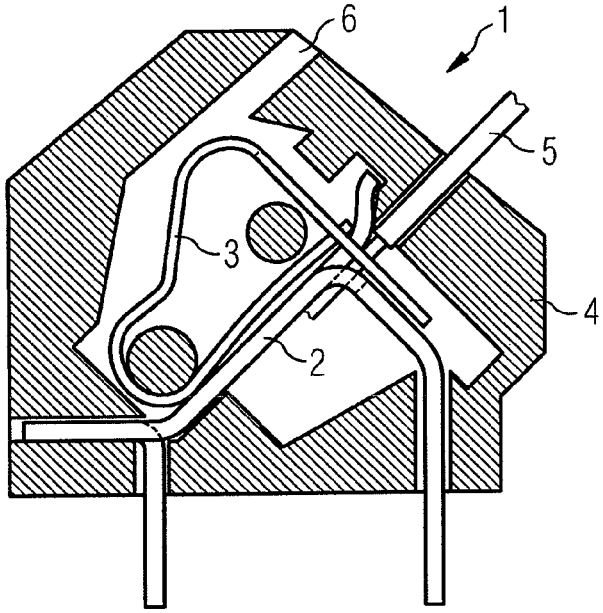
FIG 1 (Prior art)
FIG. 1 shows a terminal having a clamping spring in accordance with the prior art.

A conventional terminal comprises a terminal base 2 and a clamping spring 3 which, in the absence of an electrical conductor 5, bears on the terminal base 2 with a clamping edge. In the clamped state, as shown in FIG. 1, an electrical conductor 5 is clamped between the terminal base 2 and the clamping edge of the clamping spring 3. The terminal base 2 and the clamping spring 3 are held in position relative to each other by a housing 4. A clamping force is applied exclusively by the preloading of the clamping spring 3.

An opening 6 is disposed in the housing 4 to allow the clamping spring 3 to be tensioned or, as the case may be, a clamped electrical conductor 5 to be released. A screwdriver, for example, can be introduced through the opening and the clamping spring tensioned.

It should be noted that the terminal depicted is an exemplary embodiment with the aid of which the invention is explained. Needless to say, the invention can also be applied to spring-type terminals of different design.

Figure 2:
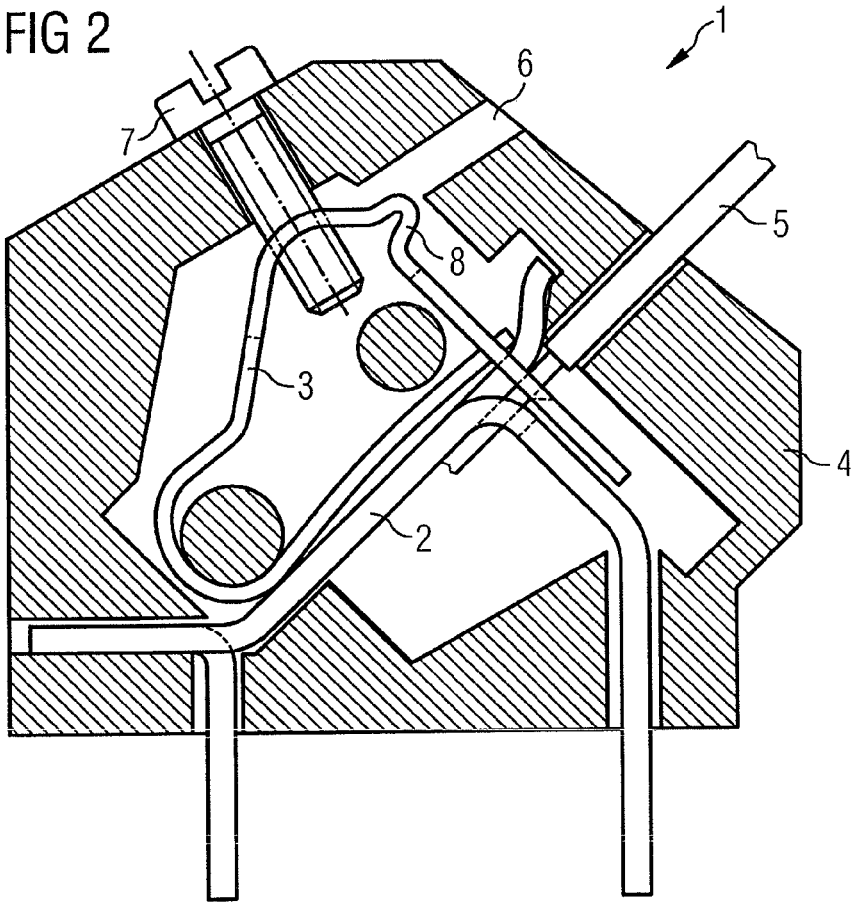
FIG. 2 shows a terminal having a clamping spring and axially moved screw with an internal thread in the clamping spring in accordance with the invention.

An embodiment of a terminal 1 in accordance with the invention is shown in FIG. 2. A thread is incorporated in the clamping spring approximately at the point at which in known terminals a screwdriver starts to tension the clamping spring 3. The thread of a screw 7 engages with the thread such that, as the screw is tightened, the clamping edge of the clamping spring 3 is moved in the direction of the terminal base 2. In this case, the screw 7 is supported with the screw head against the housing 4 comprising a support element. To allow the clamping spring 3 to be tensioned with the screw loosened, the clamping spring 3 has a convexity 8 which is accessible through an opening 6 provided therefor in the housing 4.

The clamping spring 3 is shaped such that the section between the clamping edge and the thread is substantially rigid and the preloading is effected by a resilient deformation in another section. A high level of clamping reliability is ensured in this way, because the force applied by the screw is transmitted by the rigid section of the clamping spring 3 onto the clamping edge without a spring-loaded coupling.

Figure 3:
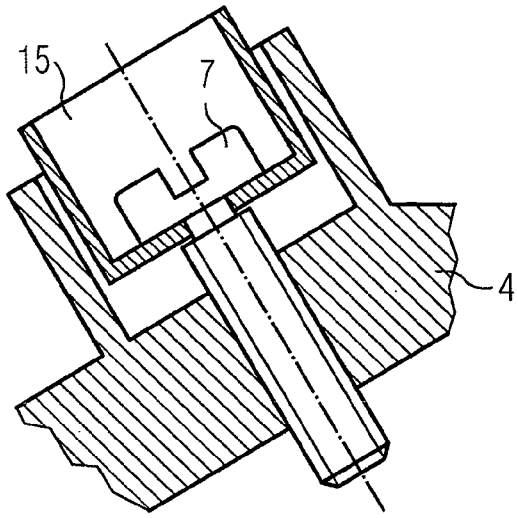
FIG. 3 shows a mechanical indicator of the screw position in accordance with the invention.

In an improved embodiment, it is indicated that a tensioning of the clamping spring 8 or, as the case may be, releasing of the terminal 1 through the opening 6 provided therefor is possible only with the screw 7 loosened. As shown in FIG. 3, the screw 7 is provided toward that end, for example, with a mechanical indicator element 15 that has a marked area that is only visible when the screw 7 is loosened. A loosened state of the screw is therefore indicated by the visible marker.

The same effect is achieved by an indicator element that is only visible when the screw 7 is tightened, i.e., when the screw 7 exerts a force onto the conductor 5 acting in addition to the spring force. The visible marker then signals a locked state of the terminal 1 in which no releasing through the housing opening 6 provided therefor is possible.

The indicator element 15 is implemented, e.g., as a plastic sleeve that sheaths the screw head and moves in conjunction with the screw 7 in the axial direction. Here, the screw head with the plastic sleeve is enclosed by a ring-shaped collar of the housing 4 such that the marked outer surface of the plastic sleeve is covered by the collar of the housing 4 when the screw 7 is tightened. Only when the screw 7 is loosened does the plastic sleeve protrude from the collar and signals by the outer lateral surface that is then visible that the terminal 1 can be released. The plastic sleeve affords the additional advantage that the screw 7 protruding from the housing collar continues to be protected against inadvertent contact.

Figure 4:
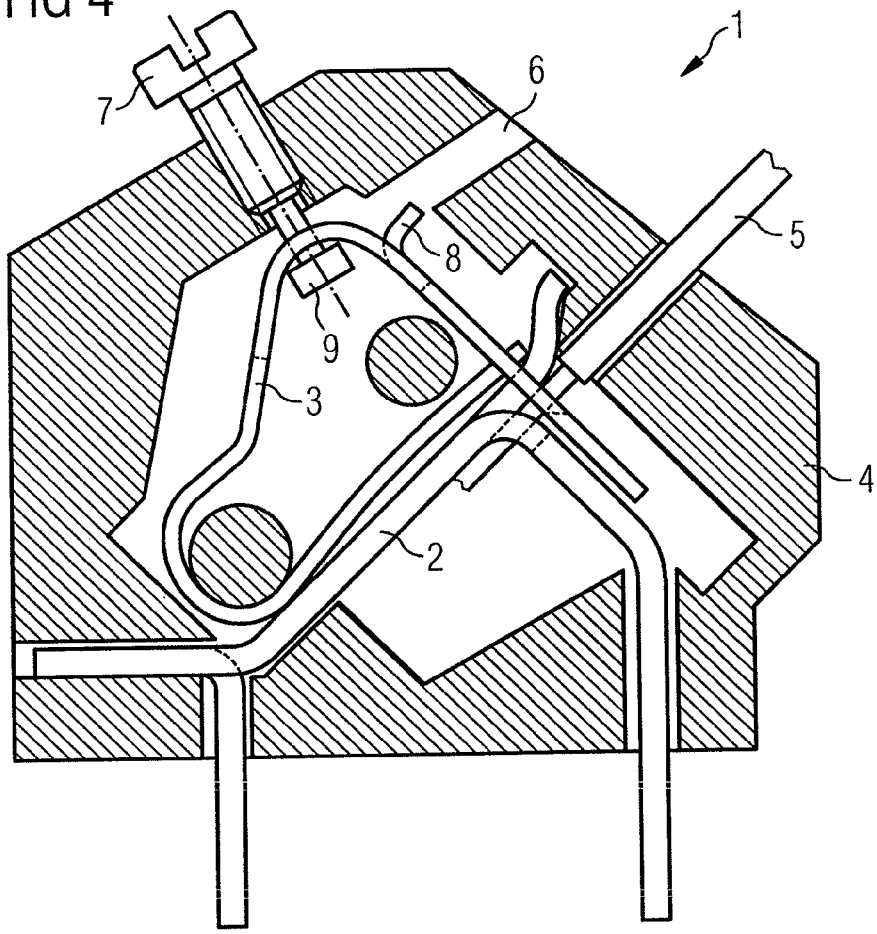
FIG. 4 shows a terminal having a clamping spring and axially moved screw with an internal thread in the support element in accordance with the invention.
Figure 5:
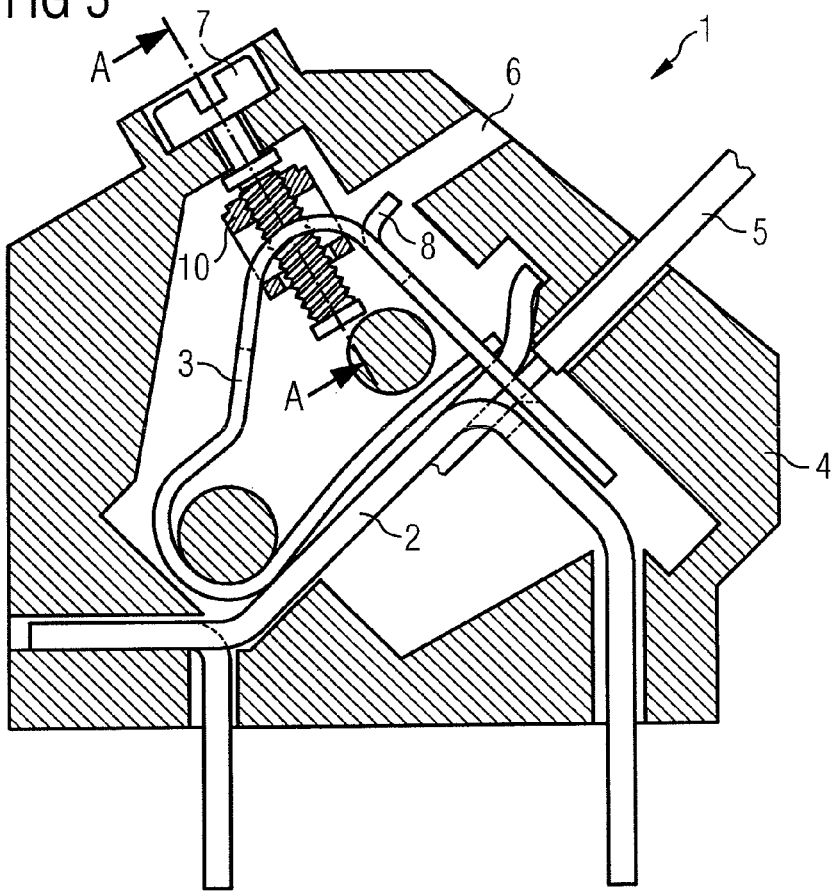
FIG. 5 shows a terminal having a clamping spring and axially fixed screw in accordance with the invention.

Another embodiment of the invention is shown in FIG. 4. The design of the terminal 1 is different from that shown in FIG. 2 in that the thread of the screw 7 engages with an internal thread of the housing 4 which comprising a support element. In this case, the thread is either formed in the housing 4, which is usually made of plastic, or contained in a bushing which is incorporated into the housing 4.

At its free end 9 the screw 7 is formed in a mushroom shape, i.e., the thread transitions into a thin section having a smaller diameter than the core diameter; an end section once more has a bigger diameter which is slightly smaller than the core diameter of the thread so that the screw can be screwed from outside into the housing. The end section is formed e.g. as a disk, sphere or similar.

Embodied in the clamping spring 3 instead of a thread is a groove in which the mushroom-shaped end 9 is guided. At the coupling point the groove, in this case, has a width that forms a clearance fit with the thin section of the mushroom-shaped end 9. At a point disposed away from the coupling point, the groove has a widening through which the thicker end section of the mushroom-shaped end 9 is inserted during assembly. Alternatively thereto, a plastic deformation of the mushroom-shaped end 9 after having been joined to the clamping spring 3 is possible.

If a sleeve having an internal thread is provided with which the thread of the screw engages, then on its outside the sleeve has a locking device to prevent it from being rotated relative to the housing in which it is held.

The coupling between the mushroom-shaped end 9 of the screw 7 and the groove of the clamping spring 3 thus enables, on the one hand, a tensile force to be applied to the clamping spring 3 when the screw 7 is unscrewed from the housing 4 and, on the other hand, a compressive force to be applied to the clamping spring 3 when the screw 7 is screwed into the housing 4.

Embodied therebetween the length of the thin section of the mushroom-shaped end 9 is a neutral zone in which the screw 7 exerts no action on the clamping spring 3. If the screw 7 is in such a position, the terminal 1 acts as a conventional spring clamp terminal.

In order to prevent the screw 7 unscrewing from the housing during a clamping operation, a further modified embodiment is provided, as illustrated in FIGS. 5-11.

The clamping spring 3 has an aperture through which the screw 7 is inserted. In this case, the thread of the screw 7 engages with an internal thread of a cage 10 that encloses the clamping spring 3. In the region of the screw head, the screw 7 is rotatably mounted in the housing 4 by a cylindrical section. A corresponding bearing bushing can be provided in this case. Embodied in the axial direction on both sides of the cylindrical section are ring-shaped shoulders, which are braced on the inner or outer edge of the housing 4 according to the respective direction of rotation. The outer shoulder is beneficially formed by the screw head. The shoulder at the transition to the thread is disposed at a disk-shaped section 12 with increased diameter.

Figure 6:
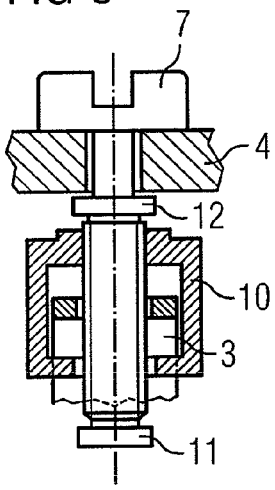
FIGS. 6-7 show a section A-A in accordance with the invention

The screw 7 is provided, for example, with a right-handed thread so that the cage 10 is pulled in the direction of the screw head when the screw 7 is turned in a clockwise direction. Here, the cage 10 exerts a tensile force on the clamping spring 7 and thereby intensifies (increases) the clamping force. Such a positional arrangement is shown in FIG. 6. It should be noted in the diagram that the clamping spring 3 is not in contact with the cage 10 in the sectional plane, but makes contact at the outer edges of the cage 10 due to the spring flexing effect.

Figure 7:
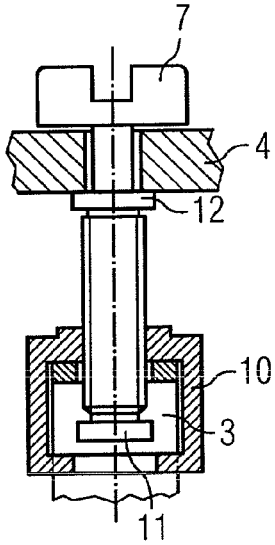

Turning the screw 7 in the anticlockwise direction causes a compressive force to be applied to the clamping spring 3 following a neutral phase with freely movable clamping spring 3. In this position, as shown in FIG. 7, the clamping spring 3 is tensioned or an electrical conductor 5 is released again. Here, an end section 11 having a larger diameter than the thread core diameter prevents the cage 10 from being unscrewed from the screw 7.

Figure 8:
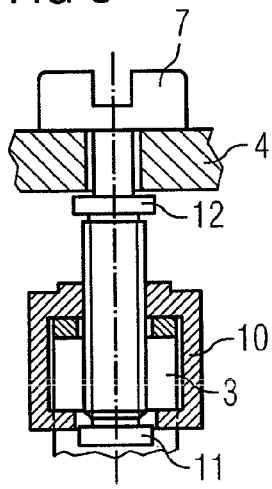
Figure 9:
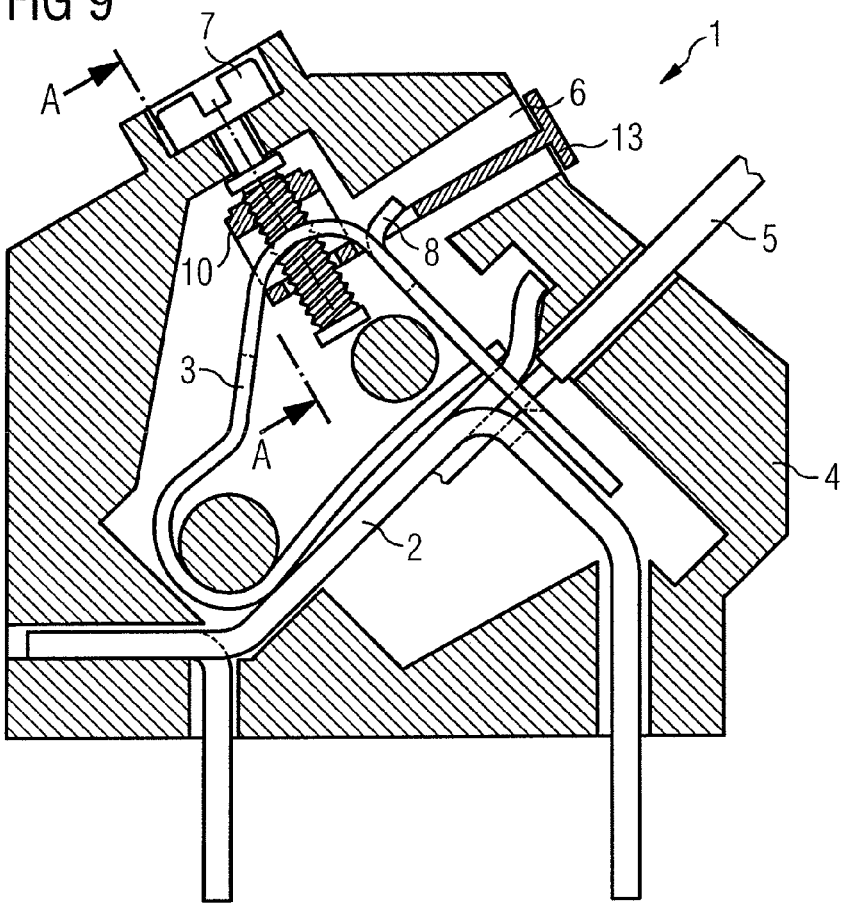
FIG. 9 shows a terminal in accordance with the invention

A position in a neutral setting is shown in FIG. 8. The clamping spring 3 can move freely within a range that is defined by the clearance of the cage 10. This state is beneficially the condition in which the terminal 1 is shipped.

The function can also be achieved with other mechanical elements instead of a cage. For example, the screw 7 can have a cylindrical core on which a sleeve having an external thread is disposed with an axial play. The thread of the sleeve is in engagement with an internal thread of the clamping spring 3. A the cylindrical core and the sleeve of the screw 7 can in this case be displaced only axially and not radially relative to each other. Here, the axial play determines the neutral zone in which the clamping spring 3 is free to move. Only when the sleeve is located against an axial stop is a turn of the screw transmitted onto the clamping spring 3.

Another alternative provides that the screw is screwed into a sleeve having an internal thread. In this case, the sleeve is co-rotatably guided in a recess of the clamping spring 3. Arranged at the front faces of the sleeve are stops by which a compressive or tensile force can be applied to the clamping spring 2. The height of the sleeve between the stops again defines the neutral zone in which the clamping spring 3 is freely movable.

An electrical conductor 5 is clamped in that the screw 7 is initially turned in the anticlockwise direction. The cage 10 moves away from the screw head, tensioning the clamping spring 3 in the process. The clamping leg of the clamping spring 3 moves away from the terminal base 2 with the clamping edge formed by a brace at the end of the clamping leg and exposes a wire inlet for inserting the electrical conductor 5.

Alternatively thereto, the convexity 8 of the clamping spring 3 can be pressed in the direction of the terminal base 2 by a screwdriver. If the clamping edge is configured in an appropriate manner, introducing the electrical conductor 5 can also cause the clamping spring 3 to move back.

After the electrical conductor 5 has been inserted into the opening provided it is clamped in position by the clamping spring 3. If the wire inlet was previously exposed by actuation of the screw 7, the screw 7 must initially be turned in the clockwise direction into a neutral position for that purpose.

If the screw 7 continues to be turned in the clockwise direction, then the spring force is additionally intensified by the screw 7 and the electrical conductor 5 is pressed more firmly against the terminal base 2. As a result, a high level of clamping reliability is established. A very high contact pressure is generated by the screw 7 being tightened. If the screw 7 should work loose as a result of material creep or extreme vibrations, then the clamping spring 3 still presses against the electrical conductor 5 with the full spring force.

A further improvement provides that a cover 13 is moved in conjunction with the cage 10. The cover 13 is pushed in front of the opening 6 for inserting the screwdriver when the clamping spring 3 is not freely movable and consequently also cannot be moved by a screwdriver by way of the convexity 8 of the clamping spring 3. In this way, an erroneous actuation of the terminal 1 is avoided in this way.

An avoidance of incorrect operation of the terminal 1 is also achieved by means of other arrangements the signal a fixing of the clamping spring 3 by the screw 7, for example, by an extension of the cage 10 being brought to the outside and its position marked accordingly.

Figure 10:
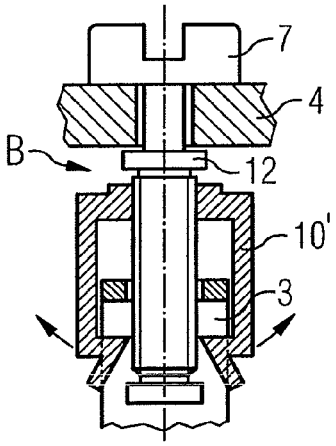
FIG. 10 shows a section A-A in accordance with the invention

A further improvement comprising a spreadable cage 10' is provided to enable the terminal 1 to be released in any case like a conventional spring clamp terminal. Such a cage is shown in FIG. 10. In this embodiment, the cage 10' does not completely enclose the clamping spring 3. The two lateral bars of the cage 10' each have a free end, at which ends inward-projecting extensions are provided which also move the clamping spring 3 during a movement in the direction of the screw head.

Figure 11:
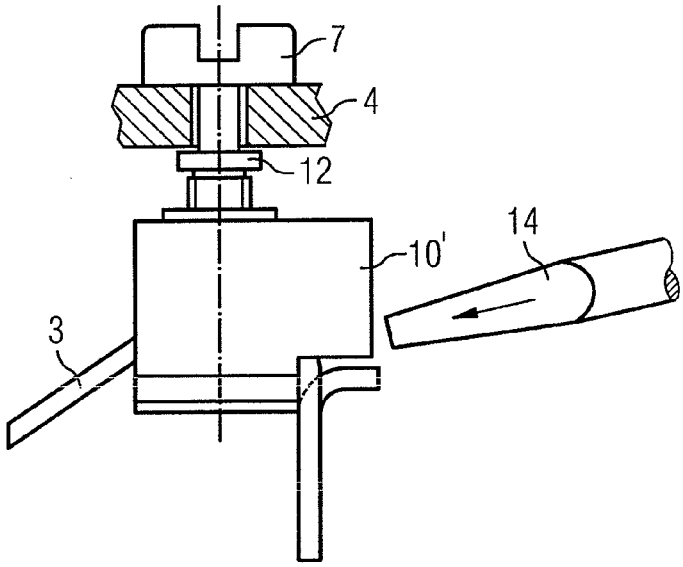
FIG. 11 shows view B in accordance with FIG. 10.

As is apparent from view B in FIG. 11, the cage 10' is configured such that a screwdriver 14 introduced to tension the clamping spring 3 initially forces itself between the two lateral bars of the cage 10' and presses these apart resiliently, as indicated by the arrows in FIG. 10. This causes the distance between the two extensions of the free ends of the cage bars to be increased to such an extent that the clamping spring 3 can be pressed out of the cage 10' by the screwdriver 14 and tensioned.

In the direction of the pressed-out clamping spring 3, the free ends of the cage bars each have an outward-pointing bevel such that the clamping spring 3 springing back into the cage 10' itself presses apart the free ends of the cage bars.

In this way, it is ensured that even with the screw 7 tightened the terminal 1 can be tensioned or, as the case may be, released by the screwdriver 14 by way of the convexity 8 of the clamping spring 3.

Figure 12:
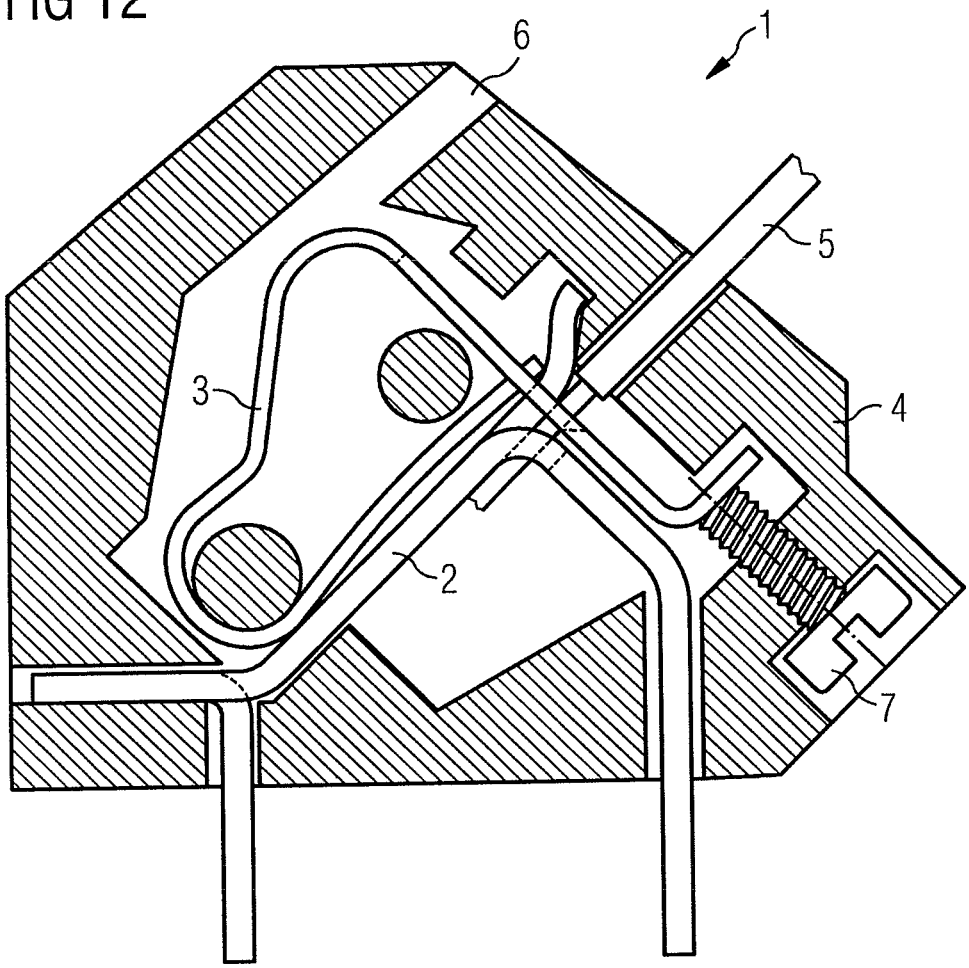
FIG. 12 shows a terminal having a clamping spring and an axially moved screw exerting compressive force action onto the clamping spring in accordance with the invention.

A further embodiment of the invention is shown in FIG. 12. Here, the screw 7 engages at the free end of the clamping leg of the clamping spring 3. The free end is bent through a right angle and consequently represents a bearing surface for the screw 7. The thread of the screw 7 engages with an internal thread of the housing 4 formed as a support element, and when the screw 7 is turned in the clockwise direction presses the free end of the clamping spring 4 and consequently the clamping edge against a tightly clamped electrical conductor 5.

The mechanism for tensioning or, as the case may be, releasing the clamping spring 3 by a screwdriver can be actuated when the screw 7 is loosened. Here, the screw 7 is disposed in a different area. As a result, no separate convexity to act as a bearing surface for the screwdriver needs to be provided for the clamping spring 3.

Figure 13:
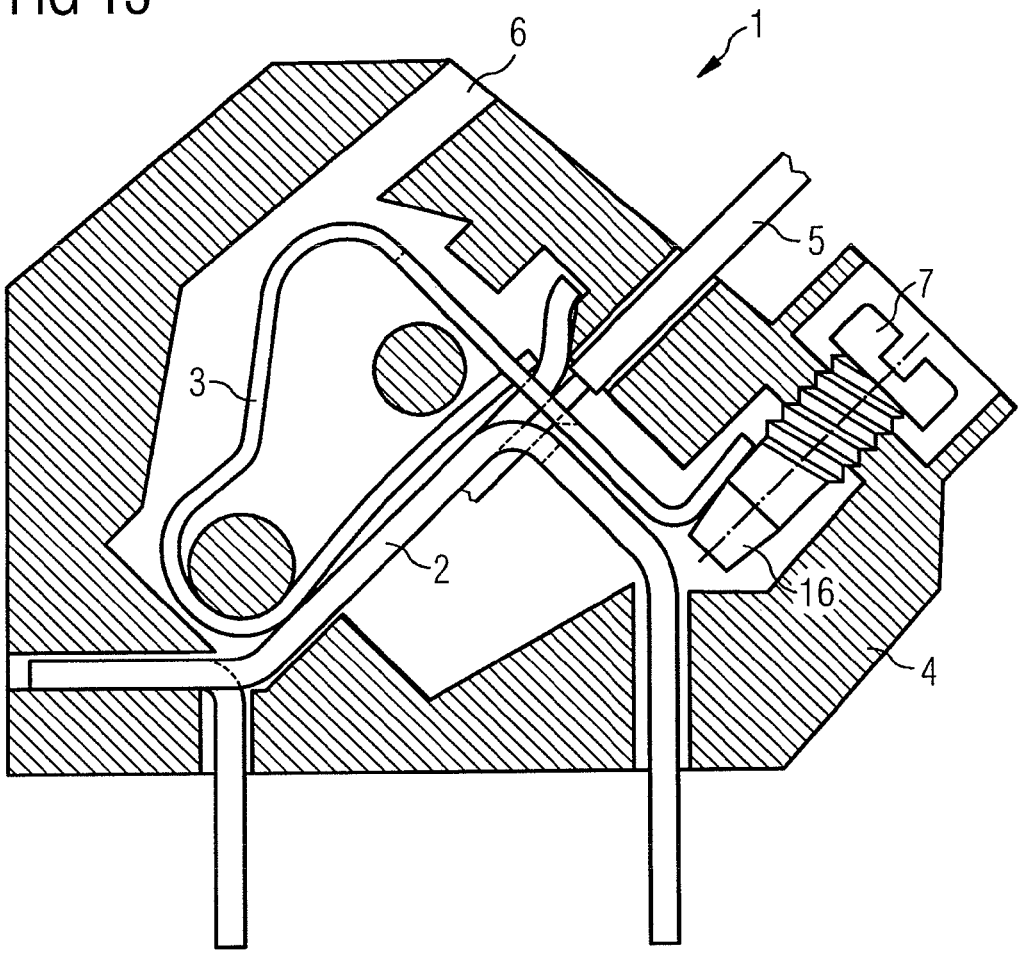
FIG. 13 shows a terminal having a clamping spring, axially moved screw and wedge-shaped intermediate element in accordance with the invention.

An embodiment offering better accessibility of the screw head is shown in FIG. 13. In this case, the axis of the screw 7 is not aligned in the direction of the clamping force, but is approximately orthogonal thereto. The screw 7 has a cone-shaped tip 16 that bears on an angled section of the clamping leg of the clamping spring 3. As the screw 7 is tightened, the screw diameter increases at the contact point between screw 7 and clamping spring 3, thereby in turn effecting a movement of the clamping leg in the direction of the clamping force and intensifying the spring force accordingly.

In this case, the screw 7 can act on an angled free end of the clamping leg or on a section of the terminal leg that lies between the clamping edge and the spring-loaded section of the clamping spring 3. In order to provide protection against contact, the screw head is again surrounded by a collar of the housing 4.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A terminal for at least one electrical conductor, comprising:

a terminal base;

a clamping spring applying a clamping to clamp the at least one electrical conductor to the terminal base; and a screw coupled to a support element such that at least one rigid section of the clamping spring which transmits the clamping force onto the at least one electrical conductor is movable relative to the terminal base by the screw to increase the clamping force effected by a preloading of the clamping spring;

wherein a thread of the screw engages with a thread of the clamping spring; and wherein a head of the screw is supported on the support element of the terminal.

2. The terminal as claimed in claim 1, wherein the terminal base and the support element are formed as a single piece.

3. A terminal for at least one electrical conductor, comprising:

a terminal base;

a clamping spring applying a clamping to clamp the at least one electrical conductor to the terminal base; and a screw coupled to a support element such that at least one rigid section of the clamping spring which transmits the clamping force onto the at least one electrical conductor is movable relative to the terminal base by the screw to increase the clamping force effected by a preloading of the clamping spring;

wherein an end of the screw is coupled to the clamping spring;

wherein a thread of the screw engages with a thread of the support element of the terminal; and wherein the end of the screw has a mushroom shape and is guided in a groove-shaped recess of the clamping spring.

4. The terminal as claimed in claim 3, wherein the end of the screw bears on the clamping spring.

5. A terminal for at least one electrical conductor, comprising:

a terminal base;

a clamping spring applying a clamping to clamp the at least one electrical conductor to the terminal base; and a screw coupled to a support element such that at least one rigid section of the clamping spring which transmits the clamping force onto the at least one electrical conductor is movable relative to the terminal base by the screw to increase the clamping force effected by a preloading of the clamping spring;

wherein the screw is rotatably mounted in the support element; and wherein a thread of the screw engages with a thread of an intermediate element coupled to the clamping spring; and wherein the intermediate element comprises a cage enclosing the clamping spring.

6. The terminal as claimed in claim 5, further comprising:

a cover;

wherein the cover is movable in conjunction with the intermediate element; and wherein the cover, when subjected to the increased clamping force exerted by the screw, covers an opening provided in a housing of the terminal for introducing a tool for tensioning the clamping spring.

7. The terminal as claimed in claim 6, wherein the intermediate element comprises a cage enclosing the clamping spring.

8. The terminal as claimed in claim 5, wherein the cage includes two resilient bars and a connecting brace having the thread; and wherein free ends of the two resilient bars include extensions partially gripping around the clamping spring.

9. The terminal as claimed in claim 6, wherein the intermediate element comprises a sleeve having an internal thread; and wherein the sleeve is guided in a recess of the clamping spring.

10. The terminal as claimed in claim 5, wherein the support element forms part of the housing of the terminal in which the terminal base is affixed.

11. The terminal as claimed in claim 5, wherein the support element is held in the housing of the terminal in which the terminal base is affixed.

12. A terminal for at least one electrical conductor, comprising:

a terminal base;

a clamping spring applying a clamping to clamp the at least one electrical conductor to the terminal base; and a screw coupled to a support element such that at least one rigid section of the clamping spring which transmits the clamping force onto the at least one electrical conductor is movable relative to the terminal base by the screw to increase the clamping force effected by a preloading of the clamping spring;

wherein the screw is rotatably mounted in the support element; and wherein a thread of the screw engages with a thread of an intermediate element coupled to the clamping spring; and wherein the intermediate element is comprises a sleeve having an internal thread; and wherein the sleeve is guided in a recess of the clamping spring.

13. A terminal for at least one electrical conductor, comprising:

a terminal base;

a clamping spring applying a clamping to clamp the at least one electrical conductor to the terminal base; and a screw coupled to a support element such that at least one rigid section of the clamping spring which transmits the clamping force onto the at least one electrical conductor is movable relative to the terminal base by the screw to increase the clamping force effected by a preloading of the clamping spring;

wherein the screw includes an inner core on which a sleeve having an external thread is co-rotatably disposed; and wherein the external thread engages with an internal thread of the clamping spring.

* * * * *